United States Patent [19]

Bruff et al.

[11] 4,001,488

[45] Jan. 4, 1977

[54] APPARATUS FOR FEEDING CHARGE TO AN ELECTRIC SMELTING FURNACE

[75] Inventors: William Bruff; Ole Andreas Kongsgaarden, both of Vagsbygd, Norway

[73] Assignee: Elkem-Spigerverket A/S, Oslo, Norway

[22] Filed: Dec. 19, 1975

[21] Appl. No.: 642,379

[30] Foreign Application Priority Data

Dec. 19, 1974 Norway ..... 4581/74

[52] U.S. Cl. ..... 13/33; 214/18 SC

[51] Int. Cl.[2] ..... F27D 3/10

[58] Field of Search ..... 13/9, 33; 214/18 R, 214/18 SC, 18 PH, 35 R, 36

[56] References Cited

UNITED STATES PATENTS

| | | | |
|---|---|---|---|
| 1,496,232 | 6/1924 | Klugh | 13/33 |
| 1,944,521 | 1/1934 | Miguet et al. | 13/33 X |
| 2,672,491 | 3/1954 | Lamb | 13/33 X |
| 3,936,588 | 2/1976 | Asphaug et al. | 13/33 |

*Primary Examiner*—R. N. Envall, Jr.
*Attorney, Agent, or Firm*—Eyre, Mann, Lucas & Just

[57] ABSTRACT

An apparatus for feeding charge to an electric smelting furnace is disclosed. The apparatus comprises a single feed hopper and a single feed tube to a separation box from whence charge can be distributed in the furnace. Segregation of the charge being fed is substantially reduced by a system of automatically operated valves.

6 Claims, 5 Drawing Figures

APPARATUS FOR FEEDING CHARGE TO AN ELECTRIC SMELTING FURNACE

The present invention relates to an electric smelting furnace and more particularly to a feed apparatus therefor which substantially reduces the likelihood of segregation of the charge being fed to the furnace.

The charge to an electric smelting furnace, particularly an electric reduction furnace, is usually supplied by means of a plurality of charging chutes which are distributed across the furnace area, each of which is connected to a separate furnace hopper. The charging chutes are kept continuously filled with charge so that new charging material will automatically be supplied as the charge within the smelting furnace sinks down during the smelting process. The charging material in the chutes will usually be slowly fed to the furnace charge. However, where collapses or sinkings in the charge within the furnace occur, a large amount of additional charge from the charging chutes will be introduced to the furnace.

For practical reasons, the charging chutes must usually be arranged with a given slope. Because the charging material to be added will be composed of a number of materials of varying particle size, the charge material will easily segregate in the chute so that the lightest and/or biggest pieces will float to the surface and the heaviest and/or smallest pieces will be preferentially passed through the charging chute. This is a very undesirable result since separation of the different components of the charge material will result in zones within the furnace, some of which will have an excess of reducing agents and others of which will have a deficiency of reducing agents. This is, of course, especially true where the charging chutes are arranged in an asymmetrical manner. This undesirable segregation of the charging material will not only have a deleterious effect on furnace operation but can also affect the composition of the resulting product.

There has now been discovered a charging apparatus whereby the possibility of the segregation of the charge fed to an electric smelting furnace is substantially reduced. The apparatus comprises for each furnace a single furnace hopper, a single chute from the furnace hopper to a splitting box and a plurality of charging chutes emanating from the splitting box. A shutoff valve is associated with each charging chute in the area adjacent the splitting box.

These and other features of the present invention may be more fully understood with reference to the drawings in which.

Figure 1:
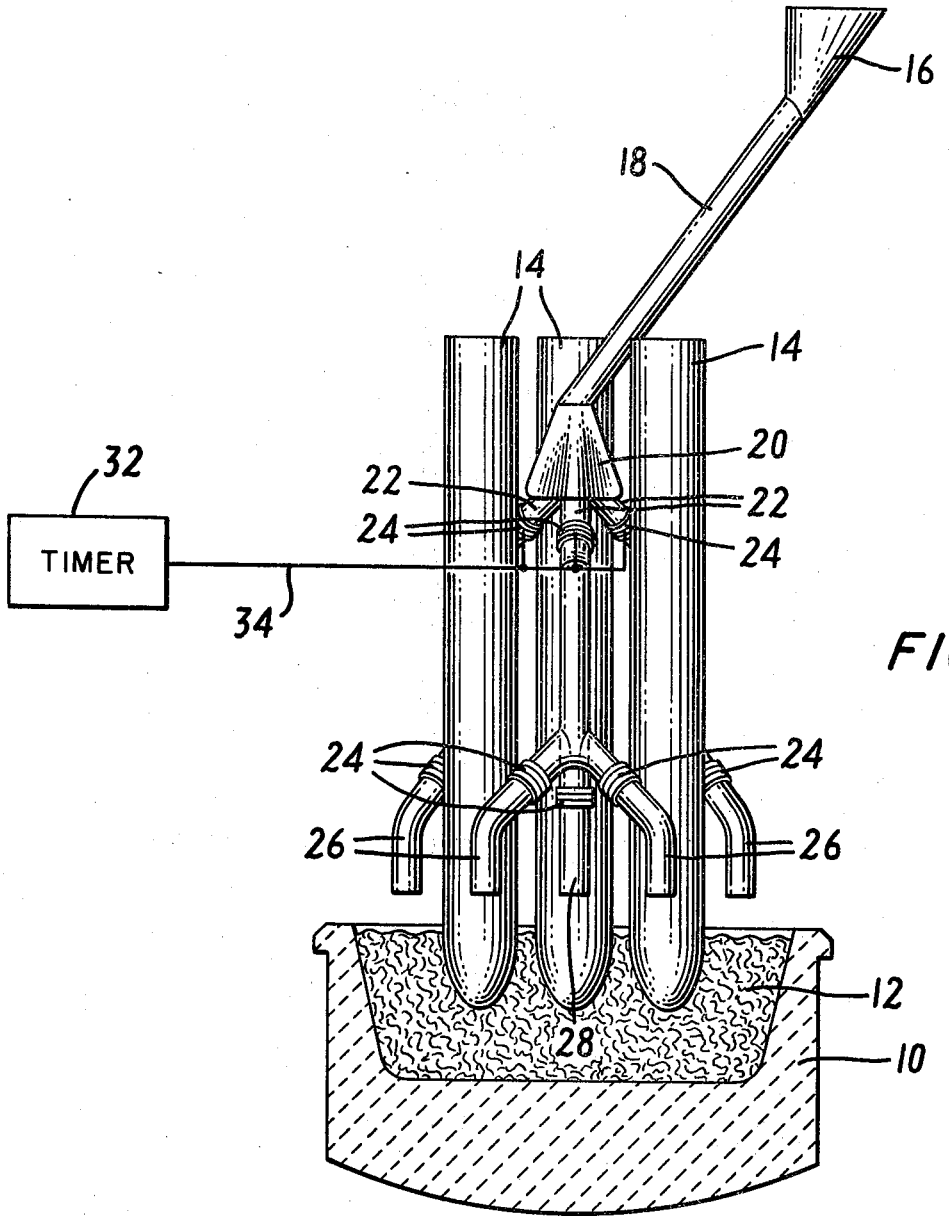
FIG. 1 is a side view of an apparatus according to the present invention.
Figure 2:
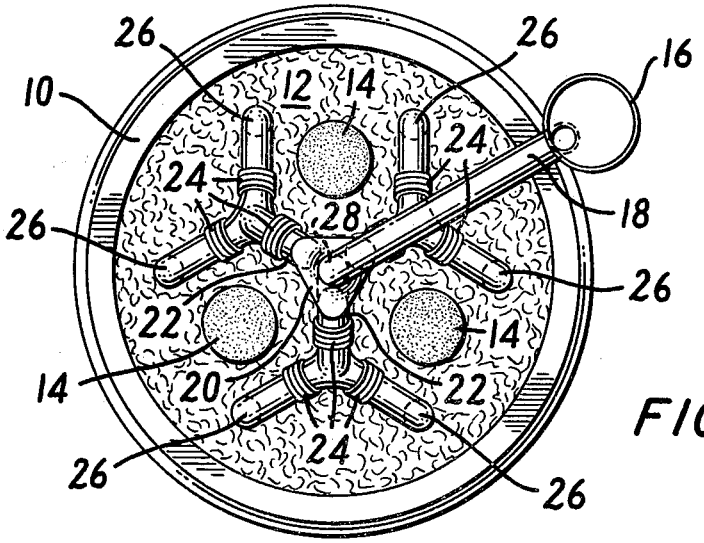
FIG. 2 is a top view of the apparatus of FIG. 1.

The apparatus of the present invention comprises a furnace pot 10 having a charge 12 situated therein. A plurality of electrodes 14 in electrode holders (not shown) are suspended in the charge 12. The feed apparatus of the present invention comprises a single hopper 16 and a single feed chute 18 which divides into a plurality of charging chutes 22, suitably by means of a distribution box 20. Each of the chutes 22 has a valve

24 associated therewith. The charging chute may simply extend directly to the area of the charge or may further include branch channels 26 as shown. If branch channels 26 are employed, it is possible that there be a valve 24 associated with each said branch channel.

In the usual electric smelting furnace there are employed three electrodes 14 arranged in triangular fashion. In accordance with the present invention, there is preferably at least one charging chute 22 for each electrode. Each charging chute is preferably additionally divided into at least two branch channels 26. There is also preferably employed a central tube 28 which feeds charge to the central part of the electrode triangle.

In operation, the valves 24 of the charging chutes 22 are associated with a timing mechanism such as timer 32 with connecting wires 34. The timer sequentially operates each of the valves 24 so that only one of the chutes 22 is open at any given time. The timer 32 may also control the valves 24 of the branch channels 26 so that only one branch channel is open at any given time. It will be appreciated that the valves 24 of the branch channels 26 are preferably programed to open and close in sequential coincidence with the opening and closing of the valve 24 associated with their charging chute 22.

Figure 3:
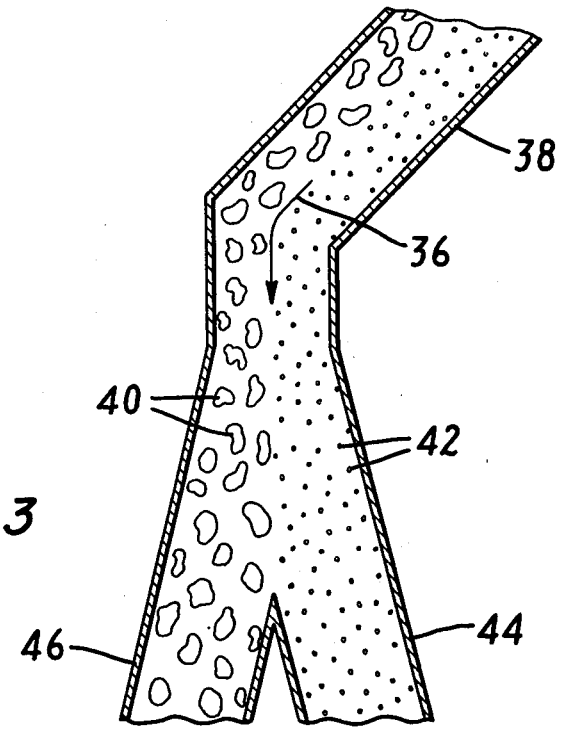
FIG. 3 shows a splitting arrangement without valves.

FIG. 3 shows a splitting arrangement with no valves present. Particulate material is fed in the direction of the arrow 36. Because the particulate material has travelled through a sloped conduit 38 it has segregated into larger particles 40 and smaller particles 42. While the degree of segregation has been emphasized for clarity, it is apparent that charging chute 44 will be predominantly material 42 while charging chute 46 will be predominantly material 40.

Figure 4:
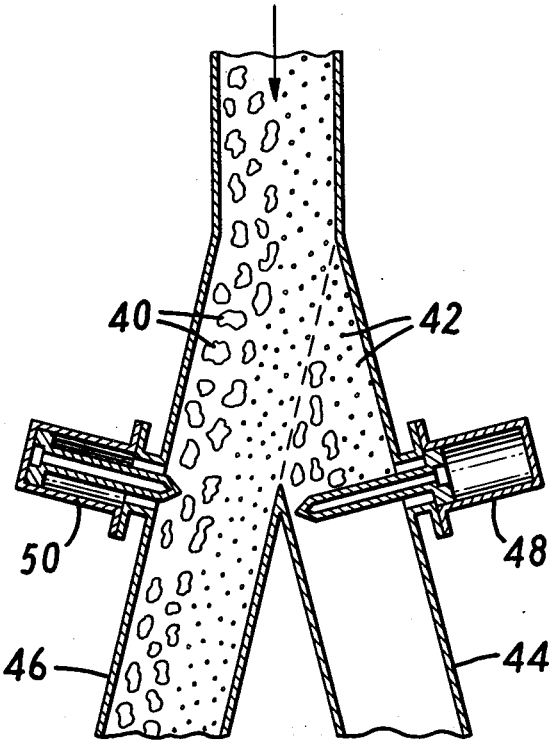
FIG. 4 shows a splitting arrangement with valves, the left one of which is open.
Figure 5:
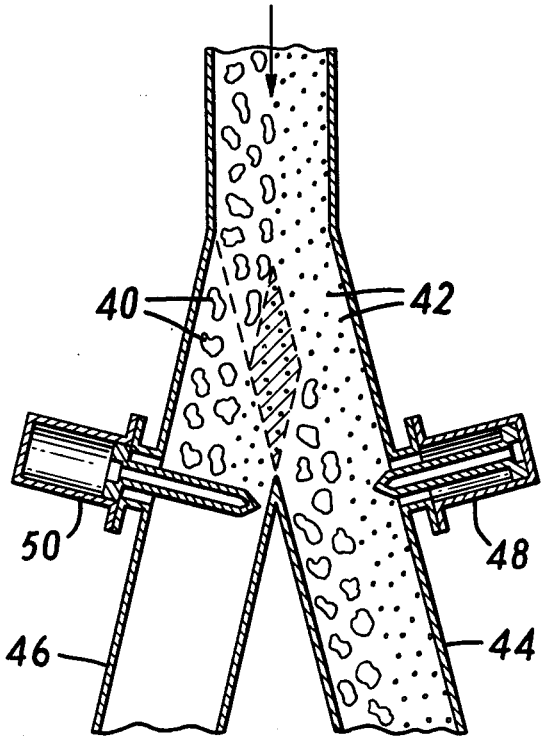
FIG. 5 shows the apparatus of FIG. 4 in its alternate position.

In accordance with the present invention, this situation is overcome by the apparatus as shown in FIG. 4 wherein valves 48 and 50 are associated with the charging chutes 44 and 46 respectively. As there shown, valve 48 has shut off flow into charging chute 44 thereby diverting it all into charging chute 46 and effectively eliminating any segregation. In FIG. 5 is shown the apparatus of FIG. 4 wherein the position of the valves 48 and 50 have been reversed so that the material is diverted from chute 46 into chute 44. Again, the segregation of material has been compensated for by having all the material travel in a single charging chute.

It will be understood that the claims are intended to cover all changes and modifications of the preferred embodiment of the invention, herein chosen for the purpose of illustration, which do not constitute departures from the spirit and scope of the invention.

What is claimed is:

1. An electric smelting furnace comprising:

a. a furnace pot adapted to contain a charge;

b. a plurality of electrodes adapted to extend into the charge within said furnace pot;

c. apparatus for feeding particulate charge material of varying particulate size to said charge, said apparatus comprising:

i. a single hopper for said particulate charge;

ii. a single feed chute having first and second ends, the first end being connected to the hopper;

iii. a plurality of charging chutes each of which has first and second ends, the first end of each of which is in communication with the second end of said feed chute;

iv. a valve associated with each said charging chute towards the first end thereof, each said valve being operative between a first position in which the said charging chute is substantially obstructed and a second position in which said charging chute is substantially unobstructed;

v. means for sequentially operating each said valve.

2. The apparatus of claim 1 wherein there are three electrodes and there is at least one charging chute for each said electrode.

3. The apparatus of claim 1 wherein the second end of said charging chute divides into branch channels.

4. The apparatus of claim 3 wherein each said branch channel has a valve associated therewith, said valve being operative between a first position in which said branch channel is substantially obstructed and a second position in which said branch channel is substantially unobstructed.

5. The apparatus of claim 4 wherein said valves are controlled by the means of part (*c*) (*v*) of claim 1.

6. The apparatus of claim 1 further including a distribution box between said feed chute and said charging chutes.

* * * * *